US006364692B1

(12) United States Patent
Okayasu et al.

(10) Patent No.: US 6,364,692 B1
(45) Date of Patent: Apr. 2, 2002

(54) WATER PROOF CONNECTOR

(75) Inventors: Yasushi Okayasu; Osamu Taniuchi; Hitoshi Okumura; Kazuhiko Fuse, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/583,326

(22) Filed: May 31, 2000

(30) Foreign Application Priority Data

May 31, 1999 (JP) ..... 11-152590

(51) Int. Cl.[7] ..... H01R 11/20; H01R 4/24; H01R 4/26

(52) U.S. Cl. ..... 439/426; 439/204; 439/595

(58) Field of Search ..... 439/204, 426, 439/936, 587, 595

(56) References Cited

U.S. PATENT DOCUMENTS 4,425,017 A * 1/1984 Chan ..... 439/276
4,875,870 A * 10/1989 Hardy et al. ..... 439/204
4,973,268 A * 11/1990 Smith et al. ..... 439/595
5,529,508 A * 6/1996 Chiotis et al. ..... 439/204
6,095,859 A * 8/2000 Maeda ..... 439/587
6,120,324 A * 9/2000 Murayama et al. ..... 439/587

FOREIGN PATENT DOCUMENTS

JP 9-134756 5/1997

* cited by examiner

*Primary Examiner*—Paula Bradley
*Assistant Examiner*—James Harvey
(74) *Attorney, Agent, or Firm*—Anthony J. Casella; Gerald E. Hespos

(57) ABSTRACT

A watertight connector is provided to create a reduced degree of connection resistance. The connector includes a female housing 20 to be connected with a male housing 10. A seal 30 is provided on the front surface of the female housing 20, and is held by a seal holder 40. The seal holder 40 presses the seal 30 against the front surface of an accommodating portion 11 to adhere the seal 30 to front opening ends of cavities 13 before the housings 10, 20 are connected with each other. Thereafter, tabs 23 penetrate the seal 30, and the seal 30 adheres to the outer surfaces of the tabs 23 to provide sealing between the cavities 13. Accordingly, during the connection of the housings 10, 20, resistance resulting from the sealing between the cavities 13 is only sliding-contact resistance created between the outer surfaces of the tabs 23 and the seal member 30.

11 Claims, 8 Drawing Sheets

WATER PROOF CONNECTOR

BACKGROUND OF THE INVENTION

1. Field of the Invention

The present invention relates to a connector with a plurality of side-by-side cavities and with a seal for water protection between the respective cavities.

2. Description of the Related Art

A prior art connector with a plurality of cavities and a seal for water protection between the cavities is disclosed in Japanese Unexamined Patent Application No. 9-134756 and in FIGS. 7 to 9 of this application. The prior art connector includes female and male connectors 1 and 2 that are to be connected to each other. The prior art connector also includes a seal 3 that is held between the housings 1 and 2. The female housing 1 includes a plurality of cavities 8 for accommodating terminal fittings 4. Engaging projections 5 are formed on the engaging face of the female housing 1 and engaging recesses 6 are formed in the engaging face of the male housings 2. The engaging projections 5 of the female housing 1 are received in the engaging recesses 6 of the male housing 2 to provide water protection between the cavities 8 when the housings 1 and 2 are mated. Additionally, the seal 3 is formed with tubular cavity sealing portions 7 which can be fitted between the engaging projections 5 and the engaging recesses 6. The cavity sealing portions 7 are mounted on the outer surfaces of the engaging recesses 6, as shown in FIG. 8, and then are inserted into the engaging recesses 6 when the connectors 1, 2 are connected with each other, as shown in FIG. 9.

Sealing between the cavities 8 of the prior art connector is achieved by holding the cavity sealing portions 7 between the engaging projections 5 and the engaging recesses 6. Accordingly, sliding-contact resistance is created between the outer surfaces of the cavity sealing portions 7 and the inner surfaces of the engaging recesses 6 during the connection of the housings. This sliding-contact resistance is large because the sliding-contact surfaces extend over the entire outer circumferential surfaces of the cavity sealing portions 7 and the entire inner circumferential surfaces of the engaging recesses 6. Connection resistance of the connector also is large due to sliding resistance in each cavity. As a result, it often is difficult to connect the male and female connectors 1 and 2 completely.

The present invention was developed in view of the above problem, and an object of the invention is to provide a watertight connector that creates a reduced degree of connection resistance.

SUMMARY OF THE INVENTION

The subject invention is directed to a connector that comprises a connector housing with a terminal-accommodating portion. The terminal-accommodating portion is formed with a plurality of cavities for accommodating a corresponding plurality of first terminal fittings. At least one seal is provided on a front surface of the terminal-accommodating portion. The connector further includes a holder for holding the seal in contact with the opening ends of the cavities. The holder may be secured to the terminal-accommodating portion.

The connector may further comprise a mating connector housing that has a receptacle into which the terminal-accommodating portion can be fitted. The mating connector may comprise a plurality of second terminal fittings that penetrate through the seal for electrical connection with the corresponding first terminal fittings in the cavities. Thus the seal may be pierced by the second terminal fittings as the first and second connector housings are mated. The second terminal fittings may be tabs that project from a bottom surface of the receptacle.

The seal may be in the form of a substantially flat plate. Additionally, the seal can be provided on a front surface of the terminal-accommodating portion for preventing water from entering into any cavity. Portions of the seal member that are penetrated by the second terminal fittings preferably are adhered to the outer surfaces of the second terminal fittings.

According to a further aspect of the invention, a connector comprises a connector housing. The connector housing includes a terminal-accommodating portion with a plurality of cavities for accommodating female terminal fittings. A seal is provided on a front surface of the terminal-accommodating portion for preventing water from entering any cavity. The connector further comprises a mating connector housing with a receptacle into which the terminal-accommodating portion can be fit. A plurality of tabs project from a bottom surface of the receptacle, and penetrate through the seal for electrical connection with the corresponding female terminal fittings in the cavities. The seal may be in the form of a flat plate and may be adhered to opening ends of the cavities by being pushed against the front surface of the terminal-accommodating portion by a holder that is secured to the terminal-accommodating portion. Additionally, portions of the seal that are penetrated by the tabs are adhered to the outer surfaces of the tabs.

Accordingly, the holder adheres the seal to opening ends of the cavities at the front surface of the terminal-accommodating portion. The seal then is penetrated by the tabs and adheres to the outer surfaces of the tabs to provide sealing between the cavities. Thus, during the connection of the connector housings, resistance resulting from the sealing between the cavities is sliding-contact resistance created between the outer surfaces of the tabs and the seal member while the seal member is being penetrated through the tabs. This reduces sliding-contact surfaces and, accordingly, reduces sliding-contact resistance. Therefore, the connection resistance of the connector can be reduced.

The seal preferably is made of a gelatinous or elastic material through which the second terminal fittings can penetrate or pierce. The use of a gelatinous material enables the sliding-contact resistance to be low while the tabs penetrate the seal. Accordingly, the connection resistance of the connector can be reduced.

Sealing performance can be improved further because the seal is adhered to the outer surfaces of the second terminal fittings or tabs due to the viscosity of the gelatinous material.

The holder of the subject invention comprises a pressing portion in the form of a substantially flat plate formed with terminal or tab insertion holes. The seal is held between the pressing portion and the front surface of the terminal-accommodating portion, preferably in a compressed state. The holder further comprises securing portions to be secured to opposite outer side surfaces of the terminal-accommodating portion. Accordingly, the flat plate-like pressing portion presses the entire front surface of the seal. As a result, sealing performance is improved because the seal member is pressed uniformly and is adhered uniformly to the opening ends of the cavities and to the outer surfaces of the tabs.

The holder preferably comprises a surrounding wall for substantially surrounding the outer periphery of a front end of the terminal-accommodating portion. Accordingly, operability can be improved because the surrounding wall of the holder is guided to a proper position and is locked in the proper position during assembly.

An elastically deformable locking piece is formed in each cavity for locking the respective terminal fitting in the corresponding cavity. Additionally, the holder is formed integrally or unitarily with a retainer for restricting elastic deformation of the locking pieces in a disengaging direction by entering a deformation permitting space of the locking pieces. The integral or unitary construction of the holder and the retainer enables the number of parts to be reduced as compared with connectors in which a retainer is formed separately.

These and other objects, features and advantages of the present invention will become apparent upon a reading of the following detailed description and accompanying drawings.

DETAILED DESCRIPTION OF THE PREFERRED EMBODIMENTS

Figure 1:
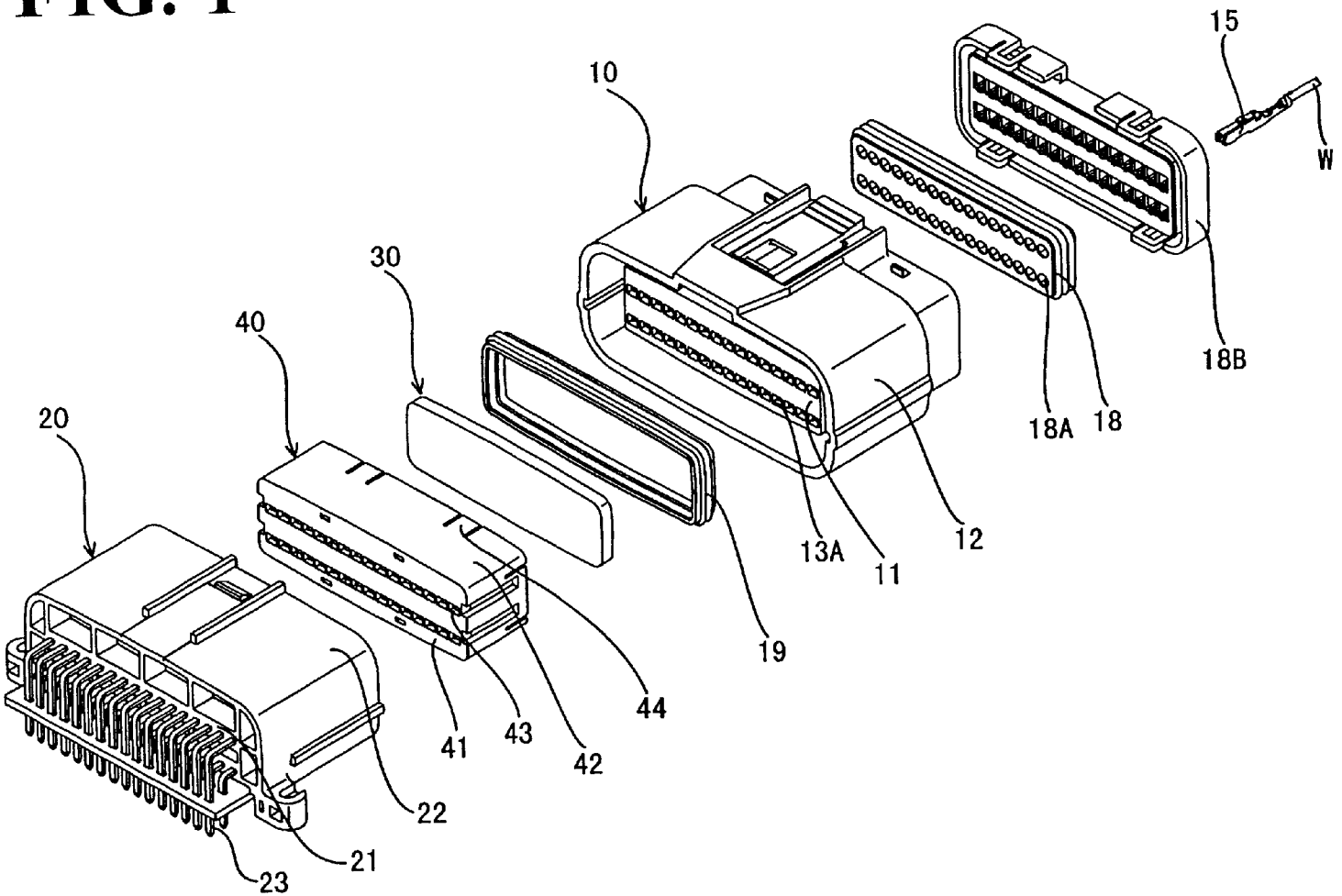
FIG. 1 is an exploded perspective view of parts of a connector according to a first embodiment of the invention.

A connector in accordance with the subject invention includes a female housing 10 that can be connected at least partly with a male connector housing 20, as shown in FIG. 1. The connector also has a seal 30 on the front surface of the female housing 10. The seal 30 held in position by a seal holder 40, as shown in FIG. 1.

Figure 3:
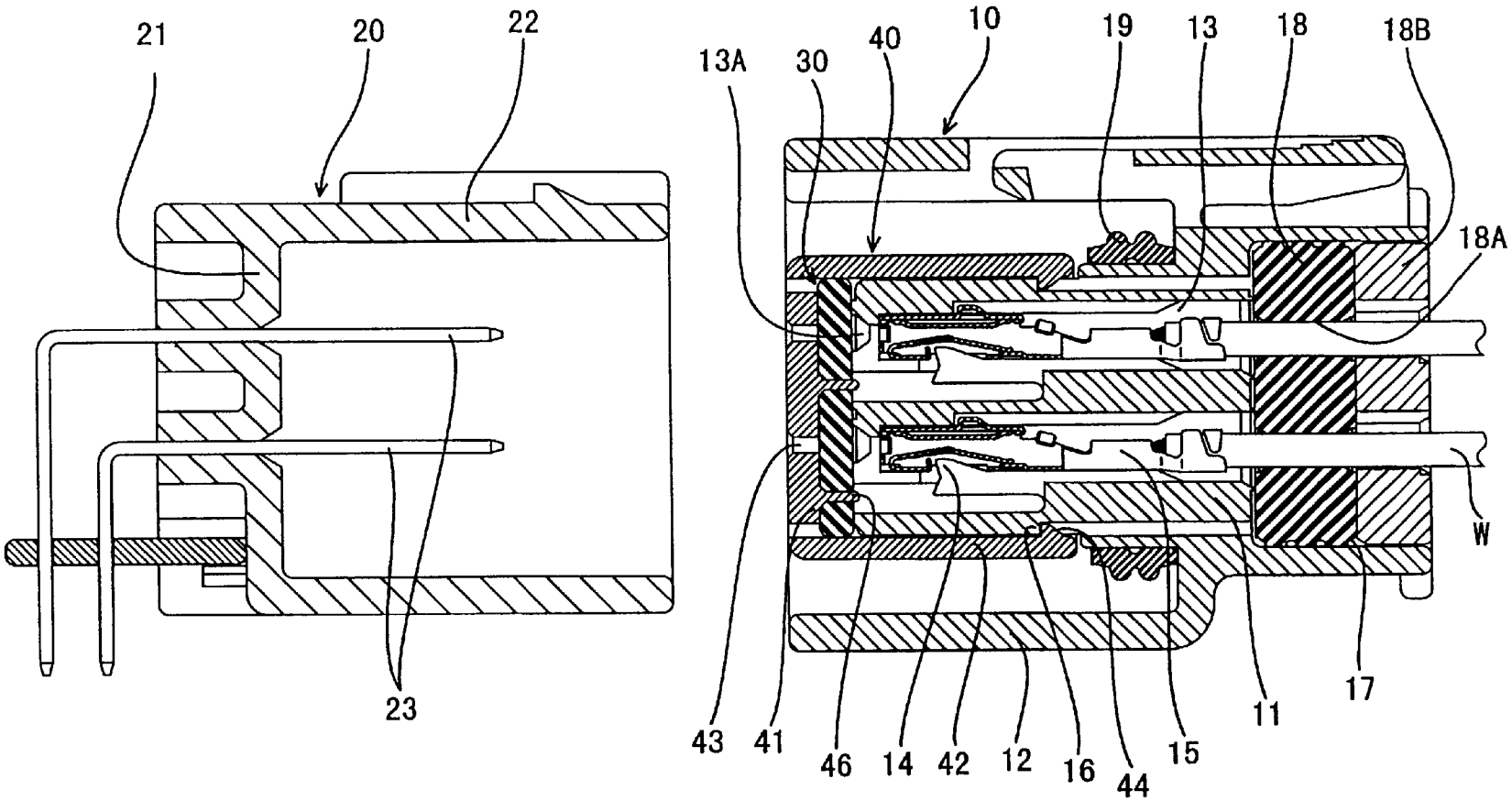
FIG. 3 is a section of the connector before being connected.

The male housing 20 is made, e.g., of a synthetic resin and has a substantially flat wide shape. As shown in FIG. 3, the male housing 20 includes a main body 21 and a receptacle 22 provided on the front or mating surface of the main body 21. A plurality of tabs 23 project at least partly into the receptacle 22 from the main body 21. The tabs 23 preferably are substantially L-shaped metal pieces, and extend from the rear surface of the main body 21 to the front surface thereof in positions corresponding to cavities 13 of the female housing 10 to be described later.

Figure 2:
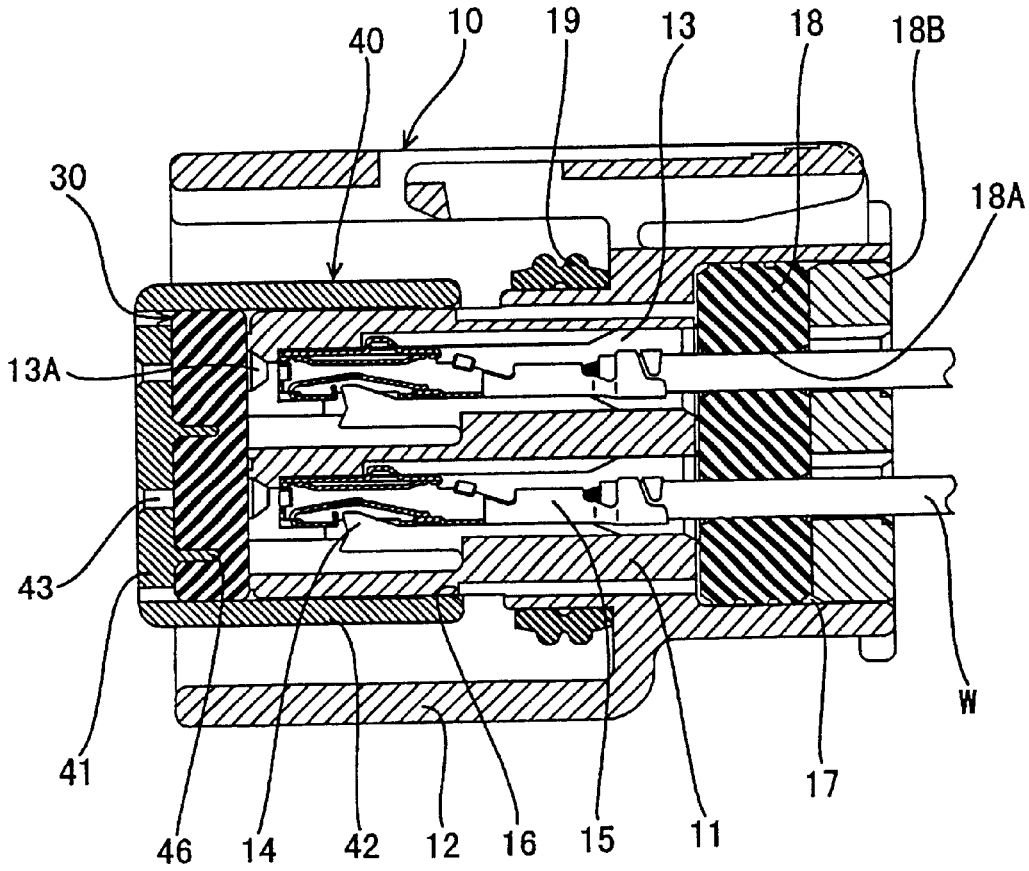
FIG. 2 is a section of a female connector housing before a seal holder is mounted.

The female housing 10 also is made, e.g., of a synthetic resin, and has a flat wide accommodating portion 11 which can be fit at least partly into the receptacle 22 of the male housing 20. The female housing 10 also has a receptacle cover 12 formed substantially around the accommodating portion 11, as shown in FIGS. 1 and 2. A plurality, e.g. sixteen, side-by-side cavities 13 are formed in each of upper and lower stages, and penetrate into the accommodating portion 11 along a connection direction. Female terminal fittings 15 are connected respectively with wires W and can be accommodated at least partly in corresponding cavities 13 of the female housing 10. A locking piece 14 is formed inside each cavity 13, and is configured for locking the respective female terminal fittings 15 in the cavities 13.

A rear-sealing portion 17 is provided at the rear end of the accommodating portion 11 for collectively sealing the rear ends of the respective cavities 13. A sealing rubber plate 18 is locked and sealed into the rear-sealing portion 17 by a rubber plate presser 18B. The sealing rubber plate 18 is formed with wire holes 18A for drawing out the wires W.

A waterproof rubber ring 19 extends over the substantially entire circumference of a portion of the outer surface of the accommodating portion 11 that is covered by the receptacle cover 12 and is provided near the base end of the receptacle cover 12 and extends over. The rubber ring 19 is provided between the opposing surfaces of the receptacle 22 and the accommodating portion 11 to provide sealing between the housings 10 and 20.

The seal 30 is made e.g. of a gelatinous or elastic material and has substantially the same flat plate shape as the front surface of the accommodating portion 11 so as to substantially cover all front opening ends 13A of the cavities 13 in the front surface of the accommodating portion 11. The gelatinous or elastic material may be a gel or elastic or rubbery material containing three-dimensional cross-linked molecular formations or behave as if it contained such molecular formations (geloids). One example of a gel that can be used is silicone gel or resin. Another suitable gel comprises a block copolymer having relatively hard blocks (e.g. hydrogenated rubber blocks) examples of such copolymers including styrene-diene block copolymers (linear or radial) for example styrene-butadiene or styrene-isoprene diblock or triblock copolymers, or styrene-ethylene-butylene-styrenes triblock copolymers. The gel may be formed from a single liquid material which becomes a gel when subjected e.g. to radiation or chemicals. Alternatively, the gel may be formed from two components, which become a gel when mixed; or the gel may be a composition, which is a gel at working temperature, e.g. room temperature. The seal 30 is held in substantially close contact with the front surface of the accommodating portion 11 by the seal holder 40 to be described later (see FIG. 3). Further, the seal 30 can be penetrated or pierced e.g. by the tabs 23 during the connection of the male and female housings 20, 10 (see FIG. 4).

The seal holder 40 is made e.g. of a synthetic resin, and is comprised of a pressing portion 41 and a substantially tubular portion 42 as shown in FIGS. 1 and 2. The pressing portion 41 is in the form of a flat plate and is formed with tab insertion holes 43 substantially in alignment with the front opening ends 13A of the cavities 13. Hooking projections 46 project backward or towards the female housing 10 from the rear surface of the pressing portion 41. The hooking projections 46 hold the seal 30 in position against the seal holder 40. The tubular portion 42 of the seal holder 40 extends backward from the outer edge of the pressing portion 41 and covers the front end of the accommodating portion 11. A total of e.g. four securing projections 44 are provided in positions spaced apart by a specified distance on the inner surfaces of the upper and lower walls at the rear end of the tubular portion 42.

The connector is assembled by initially hooking the seal 30 onto the hooking projections at the rear surface of the pressing portion 41 of the seal holder 40. The rear end of the tubular portion 42 of the seal holder 40 then is fitted to the front end of the accommodating portion 11. The tubular portion 42 is inserted further, while maintaining the front surface of the pressing portion 41 and the front surface of the accommodating portion 11 substantially parallel to each other. As a result, substantially the entire accommodating portion is covered. Additionally, the seal 30 is brought uniformly into contact with the front surface of the accommodating portion 11 while holding the rear surface of the seal 30 and the front surface of the accommodating portion 11 parallel to each other, as shown in FIG. 2. If the seal holder 40 further presses the seal 30 against the accommodating portion 11, the pressing portion 41 substantially uniformly compresses the entire front surface of the seal 30 and adheres the seal 30 to the front opening ends 13A. The tubular portion 41 guides the seal holder during this rearward movement over the accommodating portion 11, and ensures that the front surface of the pressing portion 41 and the front surface of the accommodating portion 11 remain substantially parallel to each other while the seal is being compressed. Hence the compression of the seal 30 is substantially uniform. The seal holder 40 is locked to the accommodating portion 11 by engaging the securing projections 44 with engaging portions 16 on the outer surface of the accommodating portion 11 to complete the assembly, as shown in FIG. 3. At this stage, the seal 30 is not penetrated by the tabs 23, and thus completely seals the front opening ends 13A of the cavities 13 to prevent water or the like from entering the cavities 13 of the female housing 10 before the female housing 10 is connected with the male housing 20.

Figure 4:
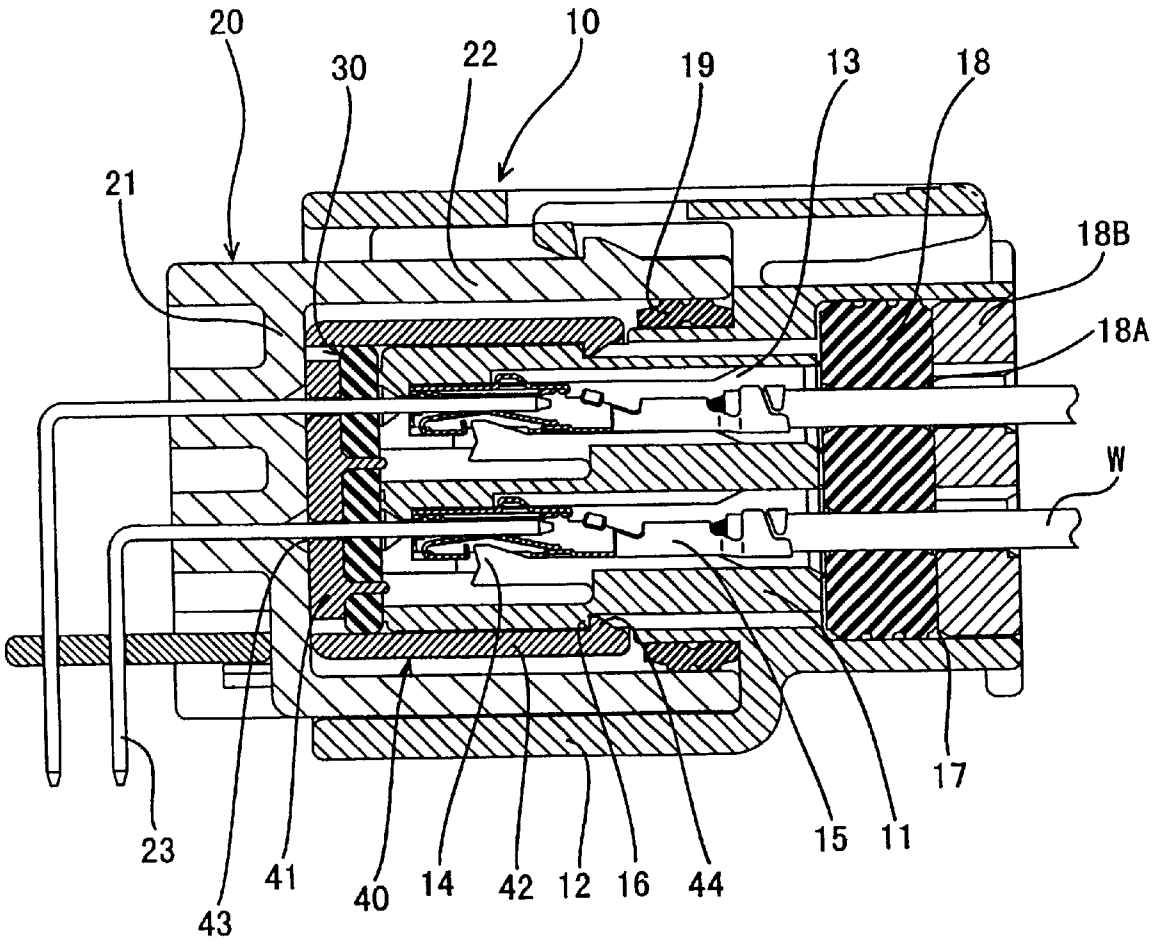
FIG. 4 is a section of the connector after being connected.

Assembly continues by connecting the male and female housings 20, 10. More particularly, the seal 30 had been mounted to the accommodating portion 11 by the seal holder 40, as described above. The accommodating portion 11 then is inserted into the receptacle 22 sufficiently for the tabs 23 to pass through the tab insertion holes 43 of the seal holder 40 and to be pressed against the seal 30. Further insertion causes the tabs 23 to penetrate through the gelatinous material of the seal 30. The tabs 23 then enter the cavities 13 and connect with the respective female terminal fittings 15 in the cavities 13. Simultaneously, the receptacle 22 compresses the rubber ring 19 and tightly holds the rubber ring 19 between the accommodating portion 11 and the receptacle 22 to provide sealing between the connector housings 10 and 20. In this way, the connecting operation is completed, as shown in FIG. 4. Portions of the seal 30 that are penetrated by the tabs 23 are adhered to the outer surfaces of the tabs 23 due to the viscosity of the seal 30. Consequently, the seal 30 provides sealing between the cavities 13.

Figure 8:
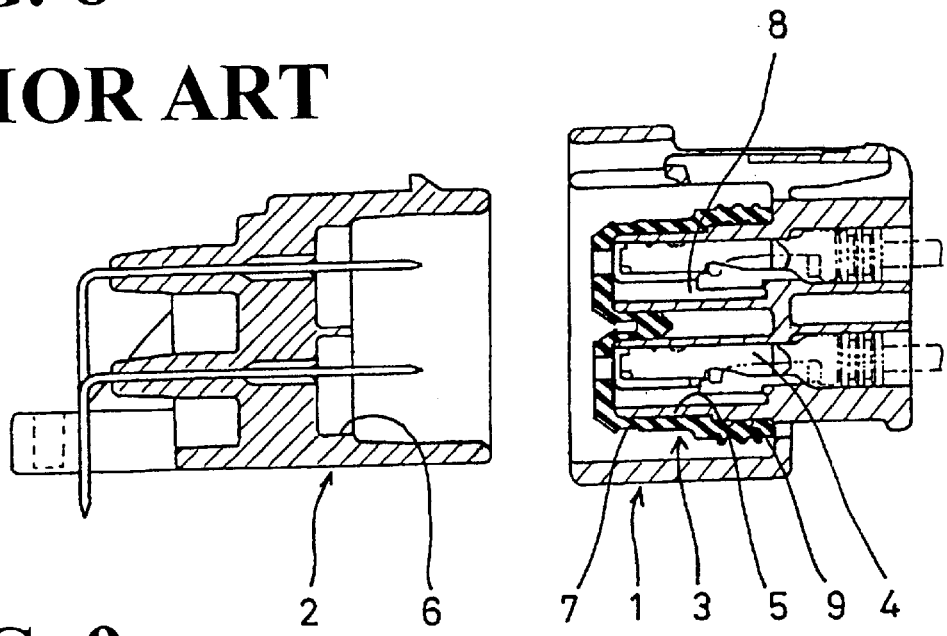
FIG. 8 PRIOR ART
FIG. 8 is a section of the prior art connector before being connected.
Figure 9:
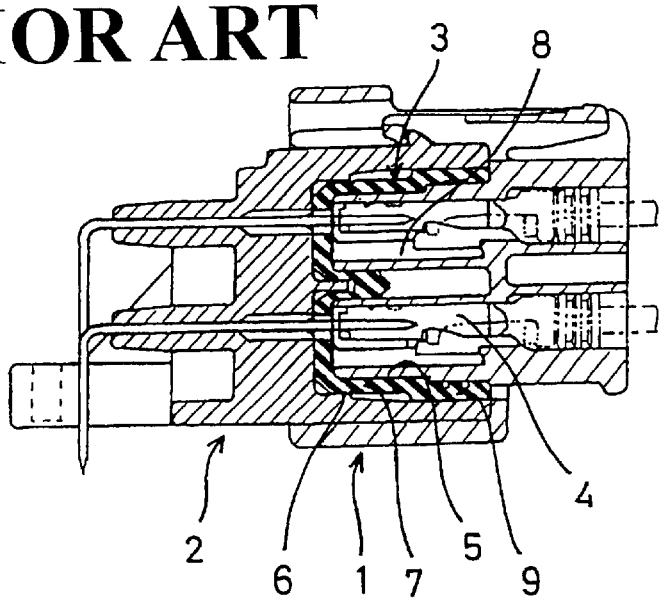
FIG. 9 PRIOR ART
FIG. 9 is a section of the prior art connector after being connected.

The connector described above ensures that the seal holder 40 presses the seal 30 against the front surface of the accommodating portion 11 before the housings 10, 20 are connected with each other, and thus adheres the seal 30 to the front opening ends 13A of the cavities 13. Thereafter, the seal 30 is penetrated by the tabs 23 and is adhered to the outer surfaces of the tabs 23 to provide sealing between the cavities 13. Thus, resistance resulting from the sealing between the cavities 13 is sliding-contact resistance created between the outer surfaces of the tabs 23 and the seal 30 during the connection of the housings 10, 20. As a result, sliding-contact surfaces can be reduced as compared with the prior art connector shown in FIGS. 8 and 9. Further, since the seal 30 preferably is made of a gelatinous material, it is easy for the tabs 23 to penetrate through the seal 30, and sliding-contact resistance is low. Therefore, the connection resistance of the inventive watertight connector can be reduced. Further, since the seal 30 is made of a viscous gelatinous material and is easily adherable to the outer surfaces of the tabs 23 penetrating therethrough, sealing performance can be improved.

The seal holder 40 is secured to the outer walls of the accommodating portion 11 by the securing projections 44 on the inner surfaces of the upper and lower walls, and the pressing portion 41 is compressed uniformly over the entire front surface of the seal 30. Accordingly, the seal 30 can be adhered uniformly to the front opening ends 13A and to the outer surfaces of the tabs 23, with the result that sealing performance can be improved.

Operability also can be improved since the tubular portion 42 of the seal holder 40 acts to guide the seal holder 40 to a proper position while the seal holder 40 is being assembled.

Furthermore, since sealing is provided between the cavities 13 when the seal 30 is mounted in the female housing 10 by the seal holder 40, entrance of water or the like into the cavities 13 can be prevented before the connection of the housings.

Figure 5:
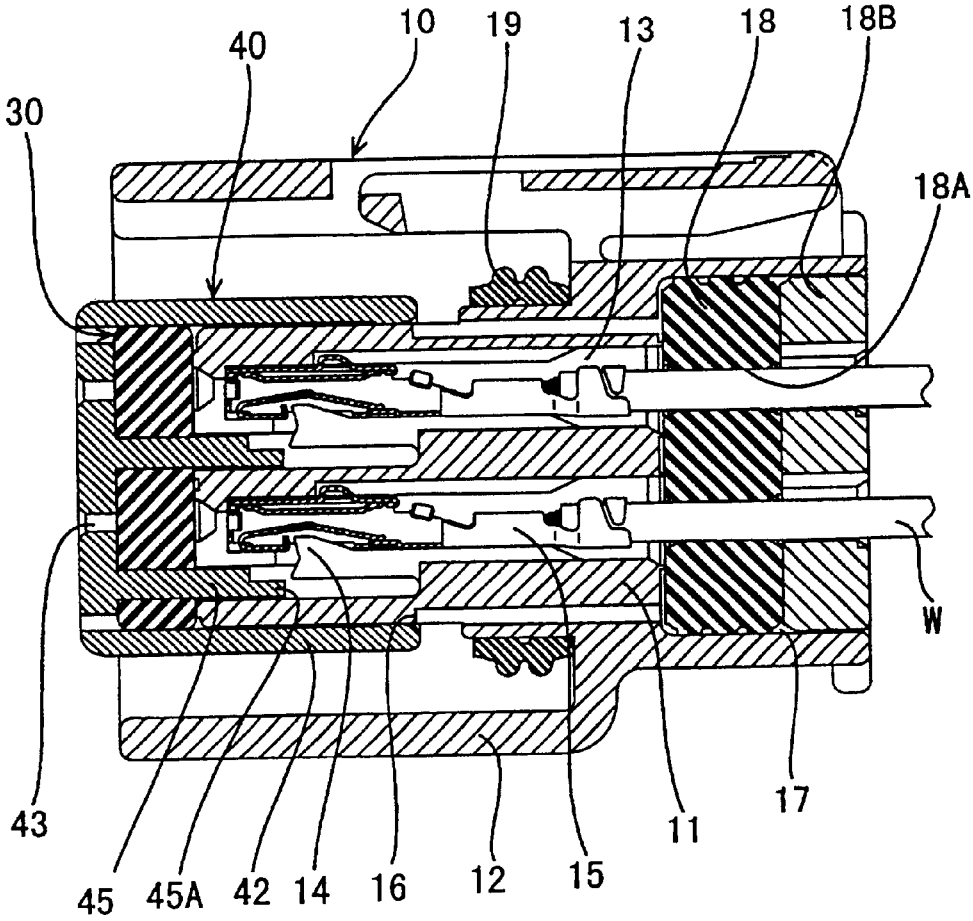
FIG. 5 is a section of a partly locked connector according to a second embodiment.
Figure 6:
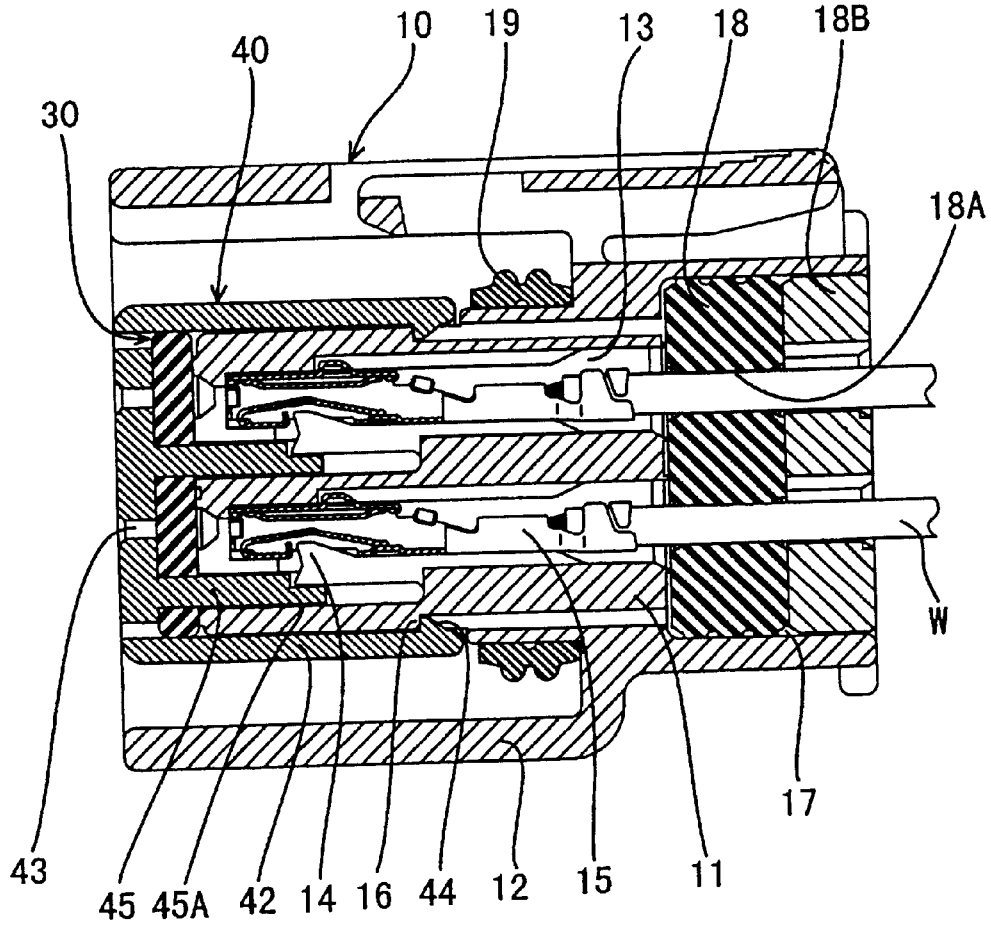
FIG. 6 is a section of the fully locked connector.
Figure 7:
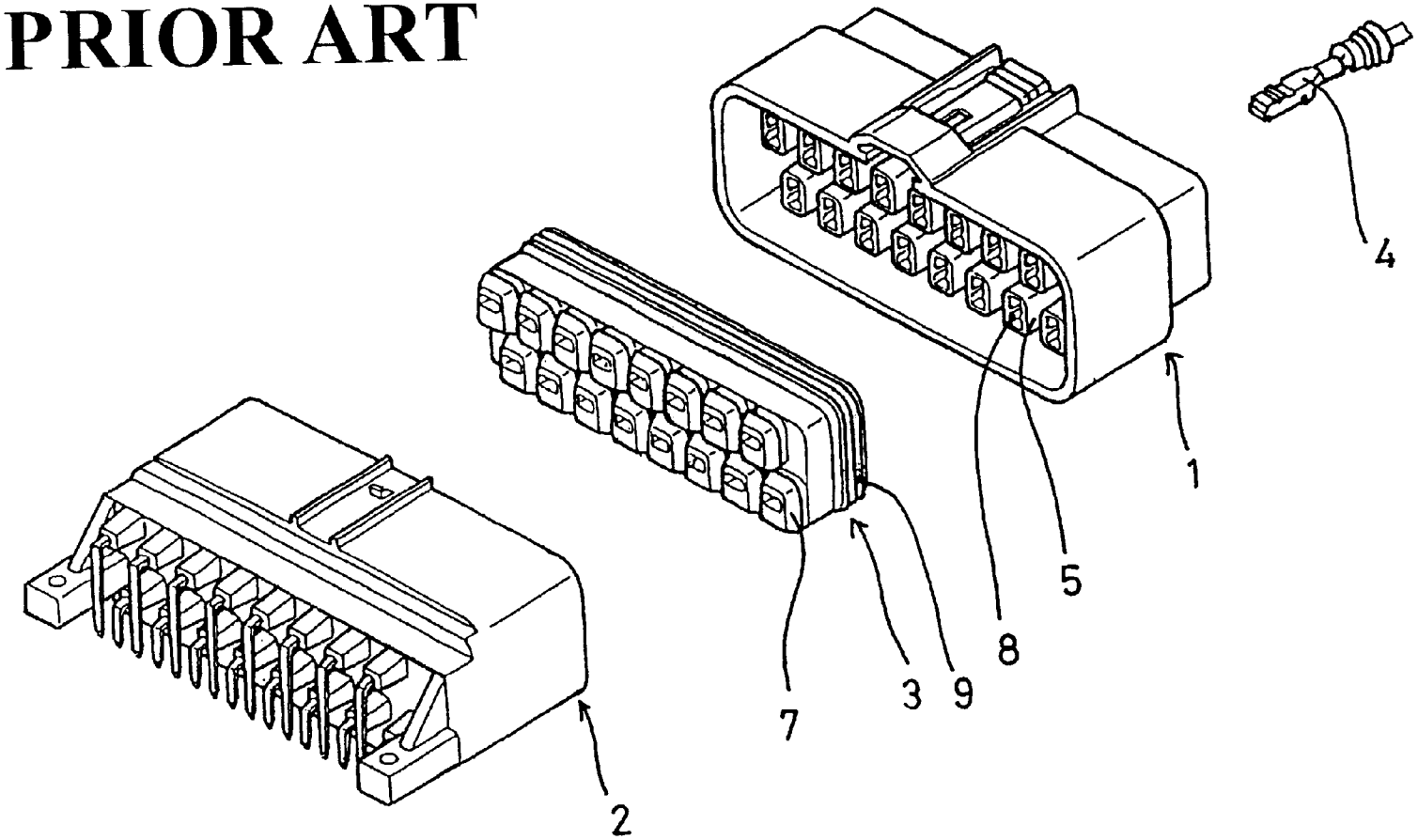
FIG. 7 PRIOR ART
FIG. 7 is an exploded perspective view of parts of a prior art connector.

FIGS. 5 and 6 show a second embodiment of the invention. The second embodiment differs from the first embodiment in that retainers 45 are provided in the seal holder 40. Since the other construction is the same as the first embodiment, no repetitive description is given thereon, and like parts are identified by the same or similar reference numerals.

The retainers 45 project backward from the rear surface of the seal holder 40, and are spaced below or laterally from the respective tab insertion holes 43 of the pressing portion 41. Additionally, the retainers 45 are provided with locking portions 45A at their leading ends (see FIG. 5). In a partly locked state, shown in FIG. 5, the female terminal fittings 15 are insertable into the cavities 13 because the locking pieces 14 are elastically deformable. Insertion of the locking portions 45A below the locking pieces 14, as shown in FIG. 6, substantially prevents the elastic deformation of the locking pieces 14, thereby fully locking the female terminal fittings 15.

According to this embodiment, the number of parts can be reduced as compared with connectors in which the retainers 45 are provided separately from the seal holder 40.

Further, the retainers 45 provided in the seal holder 40 securely fix the female terminal fittings 15 to prevent them from shaking and displacing. This prevents the seal 30 from being damaged when the female terminal fittings 15 and the tabs 23 shake after the connection of the housings. Therefore, the reliability of sealing performance can be improved and a more stable electrical connection can be established.

Furthermore, operability can be improved since the retainers 45 fully lock the female terminal fittings 15 at the same time the seal 30 is mounted by the seal holder 40.

The present invention is not limited to the above embodiments. For example, following embodiments are also embraced by the technical scope of the invention as defined in the claims. Besides these embodiments, various changes can be made without departing from the scope and spirit of the invention as defined in the claims.

Although the seal member 30 is made of a gelatinous material and is penetrated by the tabs 23 during the connection of the housings in the foregoing embodiments, it may be in the form of a rubber flat plate formed with through holes through which the tabs 23 are inserted.

Although the securing portions are provided on the upper and lower walls in the foregoing embodiments, they may be provided on the left and right side walls or on all walls. Further, the number of the securing portions is not limited to four. There may be any suitable number of the securing portions provided that they are symmetrically formed with respect to the connection direction.

What is claimed is:

1. A connector, comprising:

a connector housing having a terminal-accommodating portion with a plurality of cavities extending along a connection direction of the connector housing, the terminal-accommodating portion having a front surface aligned transverse to the connection direction, the front surface having a plurality of openings aligned respectively with the cavities;

a plurality of first terminal fittings mounted respectively in the cavities;

a seal formed from a gelatinous material having a flat plate shape, said seal extending across the front surface of the terminal-accommodating portion such that the seal covers the openings of the cavities in the front surface of the terminal accommodating portion; and a holder mounted to the terminal-accommodating portion, the holder being configured for compressing the gelatinous material of the seal against the front surface of the terminal-accommodating portion and holding the seal in contact with the front surface of the terminal-accommodating portion and across the openings of the cavities, the holder having a plurality of holes aligned respectively with the cavities but spaced from the cavities by the seal.

2. A connector according to claim 1, wherein an elastically deformable locking piece is formed in each said cavity for locking the corresponding first terminal fitting, and the holder being formed integrally with a retainer for restricting an elastic deformation of the locking pieces in a disengaging direction by entering a deformation permitting space of the locking pieces.

3. A connector according to claim 1, wherein the holder comprises at least one hooking projection projecting toward the connector housing and penetrating at least partly into the seal, the hooking projection holding the flat plate seal during mounting of the holder on the connector housing.

4. A connector according to claim 1, further comprising a rubber ring mounted around the terminal-accommodating portion at a location rearwardly of the front surface.

5. A connector according to claim 1, wherein the seal is dimensioned to substantially fill all space between the connector housing and the holder in proximity to the openings to the cavities.

6. A connector according to claim 1, further comprising;

a mating connector housing provided with a receptacle dimensioned to receive the holder, the seal and at least part of the terminal-accommodating portion; and a plurality of second terminal fittings mounted in the mating connector housing, the second terminal fittings being disposed and dimensioned to pass through the seal for electrical connection with the corresponding first terminal fittings in the cavities.

7. A connector according to claim 6, wherein the second terminal fittings are tabs projecting from a bottom surface of the receptacle.

8. A connector according to claim 6, wherein portions of the seal that are penetrated by the second terminal fittings are adhered to outer surfaces of the second terminal fittings.

9. A connector according to claim 1, wherein the holder comprises:

a pressing portion in the form of a substantially flat plate formed with terminal insertion holes, the seal being disposed between the pressing portion and the terminal-accommodating portion in a compressed state, and securing portions secured to side surfaces of the terminal-accommodating portion.

10. A connector according to claim 9, wherein the holder comprises a surrounding wall substantially surrounding outer peripheral portions of a front end portion of the terminal accommodating portion.

11. A connector comprising:

a first connector housing having a terminal-accommodating portion with a plurality of substantially parallel cavities extending therethrough along a connection direction, the terminal-accommodating portion having a front surface transverse to the connection direction, a plurality of spaced apart openings extending into the front surface for communication with the respective cavities, a cover surrounding the terminal-accommodating portion and spaced outwardly therefrom, said cover projecting forwardly beyond the front surface of the terminal accommodating portion;

a flat continuous seal mounted to the front surface of the terminal-accommodating portion and covering each of the said openings therein, said seal being formed from a gelatinous material;

a plurality of terminal fittings mounted respectively in the cavities;

a holder mounted over said seal and over portions of said terminal-accommodating portion adjacent said front surface, said holder having a pressing portion engaging said seal and compressing said seal into sealing disposition adjacent said front surface of said terminal accommodating portion, said pressing portion having a plurality of holes aligned respectively with the openings in the terminal-accommodating portion;

a second connector housing provided with a receptacle dimensioned to receive at least the holder and dimensioned to be slidably inserted into the cover of the first connector housing; and a plurality of second terminal fittings mounted in the second connector housing, the second terminal fittings being aligned and dimensioned for passage through the holes in the holder, through the seal and into the openings of the cavities for electrical connection with the first terminal fittings in the cavities, said seal sealing portions of said second terminal fitting between said holder and said terminal accommodating portion and preventing water flow between the cavities.

* * * * *

UNITED STATES PATENT AND TRADEMARK OFFICE

CERTIFICATE OF CORRECTION

PATENT NO. : 6,364,692 B1
DATED : April 2, 2002
INVENTOR(S) : Takajo et al.

It is certified that error appears in the above-identified patent and that said Letters Patent is hereby corrected as shown below:

Title page,
Item [*] Notice, delete "by 0 days" and insert -- by 65 days --

Signed and Sealed this

Eleventh Day of May, 2004

JON W. DUDAS
*Acting Director of the United States Patent and Trademark Office*